US009362614B1

(12) United States Patent
Neel

(10) Patent No.: US 9,362,614 B1
(45) Date of Patent: Jun. 7, 2016

(54) MINIMUM DEPTH SPIRAL ANTENNA

(71) Applicant: THE UNITED STATES OF AMERICA AS REPRESENTED BY THE SECRETARY OF THE NAVY, Washington, DC (US)

(72) Inventor: Michael M. Neel, Ridgecrest, CA (US)

(73) Assignee: The Government of the United States of America as Represented by the Secretary of the Navy, Washington, DC (US)

( * ) Notice: Subject to any disclaimer, the term of this patent is extended or adjusted under 35 U.S.C. 154(b) by 247 days.

(21) Appl. No.: 14/249,588

(22) Filed: Apr. 10, 2014

(51) Int. Cl.
*H01Q 1/36* (2006.01)
*H01Q 1/38* (2006.01)
*H01Q 1/50* (2006.01)

(52) U.S. Cl.
CPC ... *H01Q 1/38* (2013.01); *H01Q 1/50* (2013.01)

(58) Field of Classification Search
USPC ..... 343/895, 702, 753, 857
See application file for complete search history.

(56) References Cited

U.S. PATENT DOCUMENTS 4,823,145 A * 4/1989 Mayes ..... H01Q 9/27 343/700 MS
6,266,027 B1 7/2001 Neel
6,975,281 B2 * 12/2005 Neel ..... H01Q 1/38 343/700 MS

OTHER PUBLICATIONS

U.S. Appl. No. 13/594,574, filed Aug. 24, 2012, Freeman, Will, et al.

* cited by examiner

*Primary Examiner* — Hoang V Nguyen
*Assistant Examiner* — Hai Tran
(74) *Attorney, Agent, or Firm* — James M. Saunders

(57) ABSTRACT

A minimum depth spiral antenna includes a fiberglass circuit board with two spiraling conductive radiator arms that are etched on the fiberglass circuit board. A metallic ring is formed around the two spiraling conductive radiator arms and is mounted on the outward edge of the fiberglass circuit board. An antenna cavity cone and antenna cavity cone cap are mounted inside the antenna cavity. A tapered microstrip balun circuit is electrically-connected to the two spiraling conductive radiator arms on its proximal end and to a connector cap on its distal end. The connector cap is mounted on the lower side of a bottom plate, which forms the base of the antenna. The antenna cavity cone has a bottom lip. A wall ring is positioned between the bottom plate and the metallic ring. The wall ring connects the bottom plate to the metallic ring.

15 Claims, 14 Drawing Sheets

MINIMUM DEPTH SPIRAL ANTENNA

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to antennas and, more particularly, to two-arm spiral antennas capable of direction-finding. The antenna has a minimum cavity depth compared to current spiral antennas.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to antennas and, more particularly, to two-arm spiral antennas. The antenna disclosed has a minimum cavity depth compared with current spiral antennas.

Significant laboratory testing was conducted for an approximate 25 inch diameter, 1.5 inch deep two arm tapered cavity spiral antenna. The testing goal was to construct a spiral antenna with the minimum cavity depth possible, while maintaining a reasonable trade-off between gain and axial ratio. The boresight gain target was to be 0 dBc across the band.

A lengthy modeling and evaluation cycle yielded the cavity dimensions built and spiral arm geometry disclosed herein. A study was performed to first find the best spiral cavity construction that would enable functionality down to about 230 MHz. The results lead to the approach of using a 1.5 inch deep cavity and using a tapered cavity depth in the first 7 inch diameter (3.5 inch radius) to obtain the best boresight gain.

The spiral antenna basic is a logarithmic spiral arm geometry out to about 2.6 inch radius, matching line width and spacing to a Archimedean Spiral with a 0.2 inch arm width and 0.2 inch spacing between arms. Spiral arms are surrounded by a 25 inch inner diameter×25.8 inch outer diameter metal ring to which the antenna arms are resistively connected to a range of about 50 to 150 ohms.

Although embodiments of the invention are described in considerable detail, including references to certain versions thereof, one skilled in the art would recognize that other versions are possible such as, for example, other versions of the spiraling conductive radiator arms. Therefore, the spirit and scope of the appended claims should not be limited to the description of versions described herein.

Figure 1:
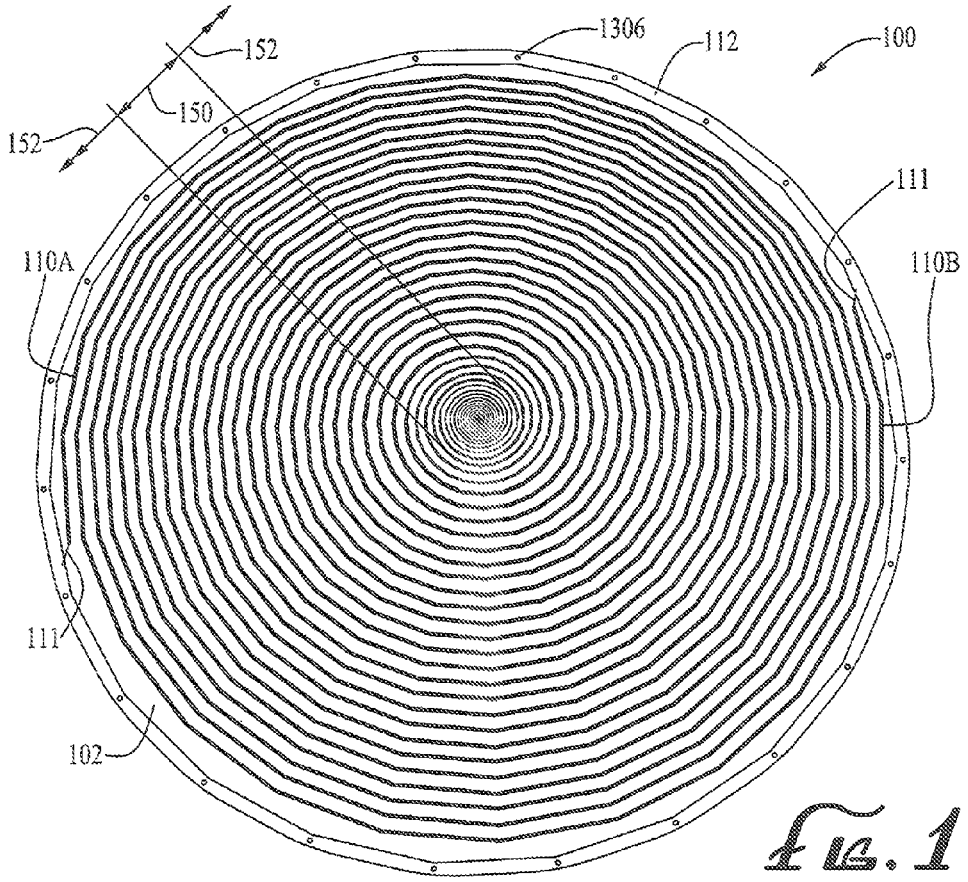
FIG. 1 illustrates a slight perspective view of a minimum depth spiral antenna, according to some embodiments of the invention.
Figure 1A:
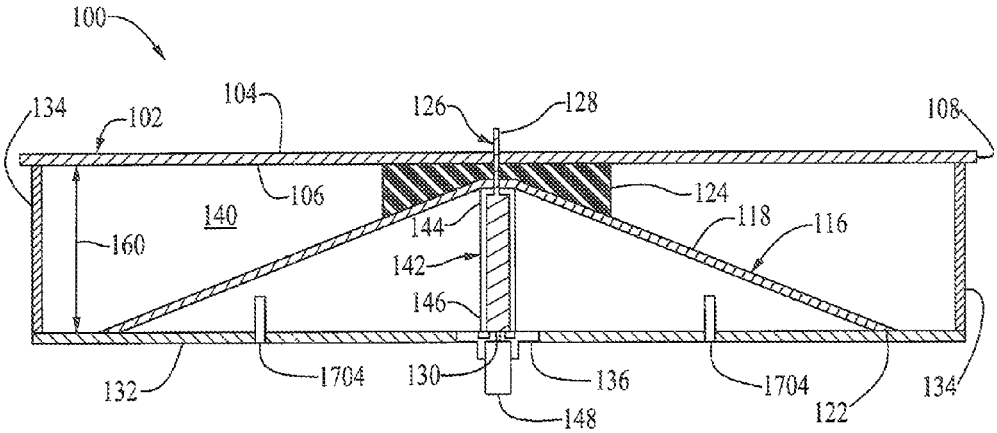
FIG. 1A is a partial section view of an antenna assembly, according to some embodiments of the invention.
Figure 1B:
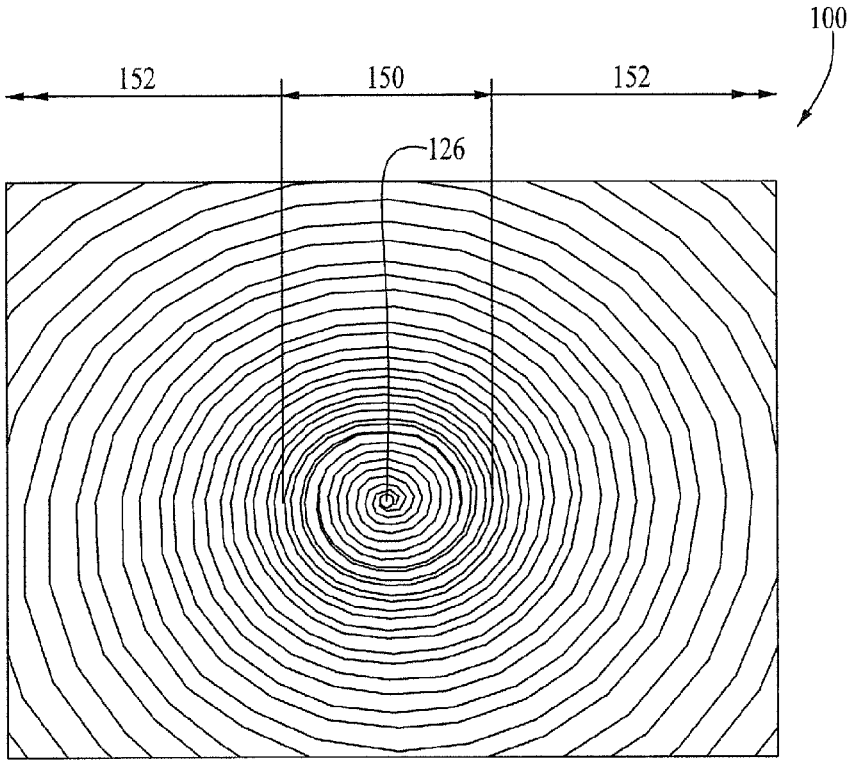
FIG. 1B illustrates a close-up partial perspective view of a minimum depth spiral antenna, according to some embodiments of the invention.

In the accompanying drawings, like reference numbers indicate like elements. Referring simultaneously to FIGS. 1, 1A & 1B, reference character 100 generally indicates an apparatus of embodiments of the invention. FIG. 1 illustrates a close-up partial perspective view of a minimum depth spiral antenna, according to some embodiments of the invention. FIG. 1A is a partial section view of an antenna assembly, according to some embodiments of the invention. FIG. 1B illustrates a partial perspective view of a minimum depth spiral antenna, according to some embodiments of the invention. The partial section view in FIG. 1A is shows material hatching patterns to help with ease of viewing and should not be construed as limiting with respect to particular types of materials.

Referring to FIGS. 1, 1A, and 1B, embodiments of the invention generally relate to a minimum cavity depth antenna includes a dielectric substrate 102 having an upper side 104, a lower side 106, and an outward edge 108. The dielectric substrate 102 may also be referred to as a printed circuit board or fiberglass printed circuit board. A spiral antenna having first and second antenna arms 110A & 11B (FIG. 1) is mounted on the dielectric substrate/printed circuit board 102. The mounting may also be referred to as etching.

A metallic ring 112 has an inner diameter of about 25 inches and outer diameter of about 25.8 inches and is formed around the first and second antenna arms 110A & 110B. The metallic ring 112, may also be referred to as a lip ring and is mounted on the outward edge 108 of the dielectric substrate/printed circuit board 102 and extends around the outward edge and adjacent to the lower side 106 of the dielectric substrate/printed circuit board.

An antenna cavity cone 116 has an outer surface 118 and a bottom lip 122. The antenna cavity cone 116 is shown to be substantially flat on its end closest to the dielectric substrate/printed circuit board 102, although the antenna cavity cone may also be conical, approximating a point at one end, also. An antenna cavity cone cap 124 is adjacent to the outer surface 118 of the antenna cavity cone 116. The antenna cavity cone cap 124 is attached to the lower side 106 of said dielectric substrate 102. The antenna cavity cone cap 124 is a non-electromagnetic energy absorbing material such as, for example, foam.

A tapered microstrip balun circuit 126 is shown. The tapered microstrip balun circuit 126, sometimes referred to simply as a balun, has a proximal end 128 and a distal end 130. The tapered microstrip balun circuit 126 has impedance taper. The tapered microstrip balun circuit 126 is electrically-connected (such as with copper wires) to the first and second antenna arms 110A & 110B at its proximal end 128.

A bottom plate 132 (also referred to as a base plate) is attached to the bottom lip 122 of the antenna cavity cone 116. A wall ring 134 is positioned between the bottom plate 132 and the metallic ring 112. The wall ring 134 connects the bottom plate 132 to the metallic ring 112. A connector cap 136 is mounted on the lower side of the bottom plate 132. The connector cap 136 is electrically-connected to the distal end 130 of the tapered microstrip balun circuit 126. The connector cap 136 is brass. Reference character 148 generically illustrates an input source such as, for example, a threaded connector that is configured to mate with the connector cap 136.

The first and second antenna arms/two spiraling conductive radiator arms 110A & 110B may also be referred to as radiation filaments or filament arms, and have logarithmic spiral antenna arm geometry from the center of the dielectric substrate/fiberglass circuit board 102 radially out to about 2.6 inches. At about 2.6 inch radius, the first and second antenna arms/two spiraling conductive radiator arms 110A & 110B transition to Archimedean spiral arms having arm widths of about 0.2 inches and arm spacing of about 0.2 inches. Reference characters 150 and 152 (FIGS. 1 and 1B) depict the logarithmic and Archimedean geometries, respectively. Archimedean geometry may sometimes be referred to as equiangular. The two spiraling conductive radiator arms/first and second antenna arms 110A & 110B have a diameter of about 28 inches. The wall ring 134 has a wall height of about 1.5 inches.

The antenna cavity cone 116 is electrically-conductive and defines a cavity 140. The cavity 140 has a tapered cavity depth from the center of the dielectric substrate/fiberglass circuit board 102 radially out to about 3.5 inches. The cavity depth (reference character 160 in FIGS. 1A & 13B) then transitions to about 1.5 inches at the 3.5 inch radius point of the dielectric substrate/fiberglass circuit board 102, and then remains at about 1.5 inches to the wall ring 134. The cavity 140 may be a void or partially filled with electromagnetic energy absorbing material. The antenna cavity cone 116 is aluminum. The outer surface (upper side) 118 of the antenna cavity cone 116 is a polished aluminum surface.

The diameter of the dielectric substrate/fiberglass circuit board 102 is about 25.8 inches. The metallic ring 112 is sometimes referred to as a "lip ring" and has a diameter of about 25.8 inches in diameter. The metallic ring 112 is about 0.15 inches thick. The wall ring 134 is about 0.15 inches thick. Both the metallic ring 112 and the base plate 132 are tack welded to the wall ring 134, although other attachment mechanisms may be used without detracting from the merits or generality of embodiments of the invention. The base plate 132 is about 0.1 inches thick.

The dielectric substrate/fiberglass circuit board 102, antenna cavity cone cap 124, antenna cavity cone 116, and the bottom plate 132 have at least one aperture extending through each component. The antenna cavity cone cap 124 is foam or a similar material. The antenna cavity cone cap 124 has a diameter of about 2.0 inches and is adjacent to and centered on the bottom side of the dielectric substrate/fiberglass circuit board 102.

In one embodiment, the tapered microstrip balun circuit 126 has an impedance taper of about 50 to 100 ohm. In another embodiment, the impedance is about 50 ohm. Another embodiment has an impedance of about 100 ohm.

A cone insert 142 resides inside the antenna cavity cone 116. The cone insert 142 is an aluminum cylinder having a proximal end 144 and a distal end 146. The proximal end is attached to the underside of the antenna cavity cone 116. The distal end 146 of the cone insert 142 is attached to the bottom plate 132. The cone insert 142 is a hollow cylinder and is a conduit for the tapered microstrip balun circuit 126.

In FIG. 1, resistors 111 are connected to the metallic ring 112. Thus, the two spiraling conductive radiator arms 110A & 101B are resistively terminated on opposing edges of the dielectric substrate/printed circuit board 102 at first and second resistors 111. The resistors 111 are connected to the metallic ring 112. The resistors 111 are mounted on opposing edges of the dielectric substrate/printed circuit board 102, approximately 180 degrees apart from each other. The resistors 111 prevent reflection of electromagnetic energy back toward the center of the dielectric substrate/printed circuit board 102. A person having ordinary skill in the art will recognize that other appropriate resistive termination techniques are possible without loss of generality or detracting from the merits of the invention.

The dielectric substrate/fiberglass circuit board 102 is approximately 0.040 inch thick and has a small center hole for the balun feed 126 and a tin/lead plating for corrosion protection. The center hole can be any shape, although the modeled shape was rectangular.

The balun 126 and connector (connector cap 136) it is mounted on are carefully inserted in the antenna cavity assembly (see FIGS. 1A and 13A) after the dielectric substrate/printed circuit board 102 is mounted on top of the wall ring 134. Balun 126 feed line is aligned with the antenna center hole and the balun connector cap 136 is secured with screws. The balun 126 is then connected with curved copper lines to the antenna (at the innermost points of the two spiraling arms 110A & 110B).

Figure 2:
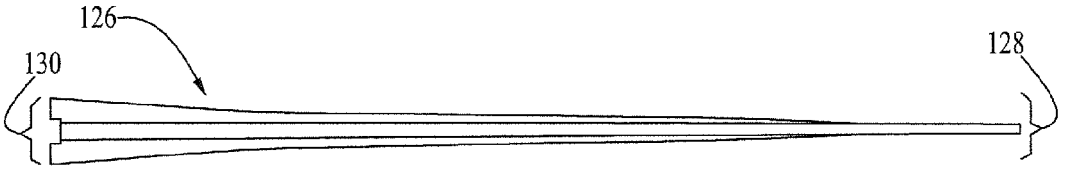
FIG. 2 illustrates a view of the balun geometry, according to some embodiments of the invention.

FIG. 2 depicts a view of the balun geometry, according to some embodiments of the invention, and is depicted as reference character 126. The balun 126 was constructed using tapered microstrip geometry on Duroid® 5880 material, having a 1.5 inch length to match the cavity depth (the height of the wall ring 134). The spiral arm spacing was reduced in the center of the antenna 100 to reduce the impedance and better match the impedance of the balun at approximately 100 ohm. The balun 126 was housed in a hole (aperture) in the tapered antenna ground, with about 0.15 inches protruding above the antenna plane to allow for mating to the antenna center hole (aperture). The balun 126 has a signal input at its distal end 130 (base of the antenna 100) and a signal output at its proximal end 128 (upper end of the antenna to connect with the spiraling arms 110A and 110B).

Figure 3A:
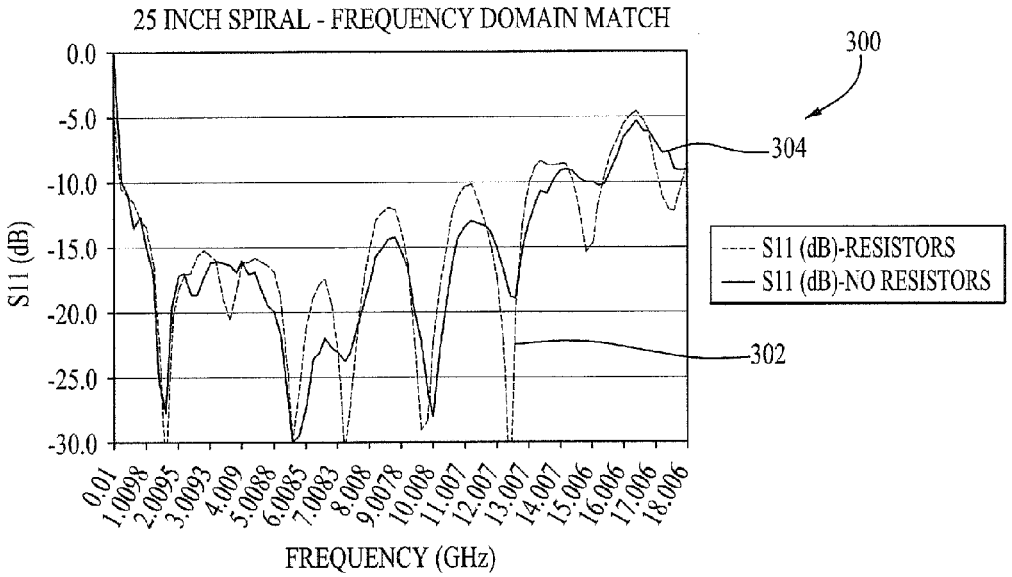
FIG. 3A illustrates the balun/antenna match in the frequency domain, according to some embodiments of the invention.
Figure 3B:
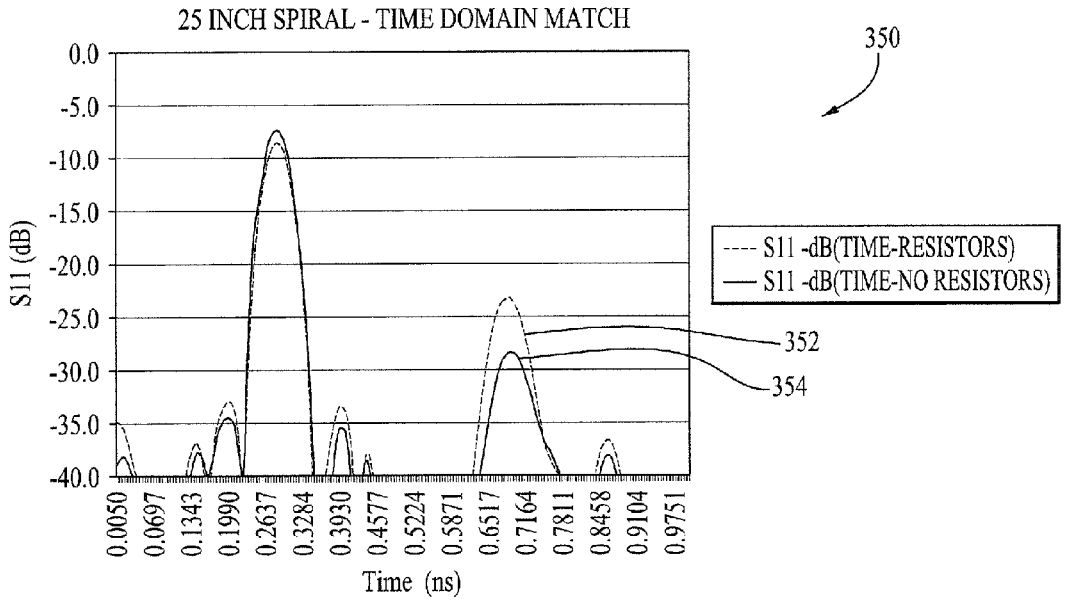
FIG. 3B illustrates the balun/antenna match in the time domain, according to some embodiments of the invention.

FIG. 3A illustrates the balun/antenna match in the frequency domain, and is depicted as reference character 300. Curve 302 has resistors. Curve 304 has no resistors. FIG. 3B illustrates the balun/antenna match in the time domain, and is depicted as reference character 350. Curve 352 has resistors. Curve 354 has no resistors. The results indicate that the S11 is better than −10 dB up to 16 GHz and down to 200 MHz, at worst −5 dB at 17.3 GHz. This confirms the success of matching to the antenna with a short (1.5 inch) balun length.

Figure 4A:
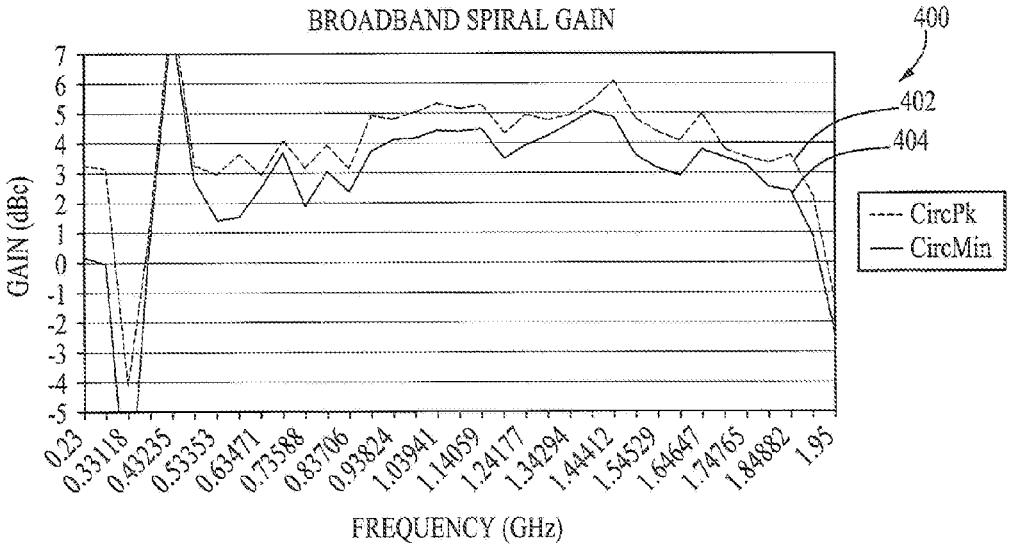
FIG. 4A illustrates the gain at boresight versus frequency (broadband spiral gain) for the range of approximately 0.2 GHz (230 MHz) to approximately 2 GHz match, according to some embodiments of the invention.
Figure 4B:
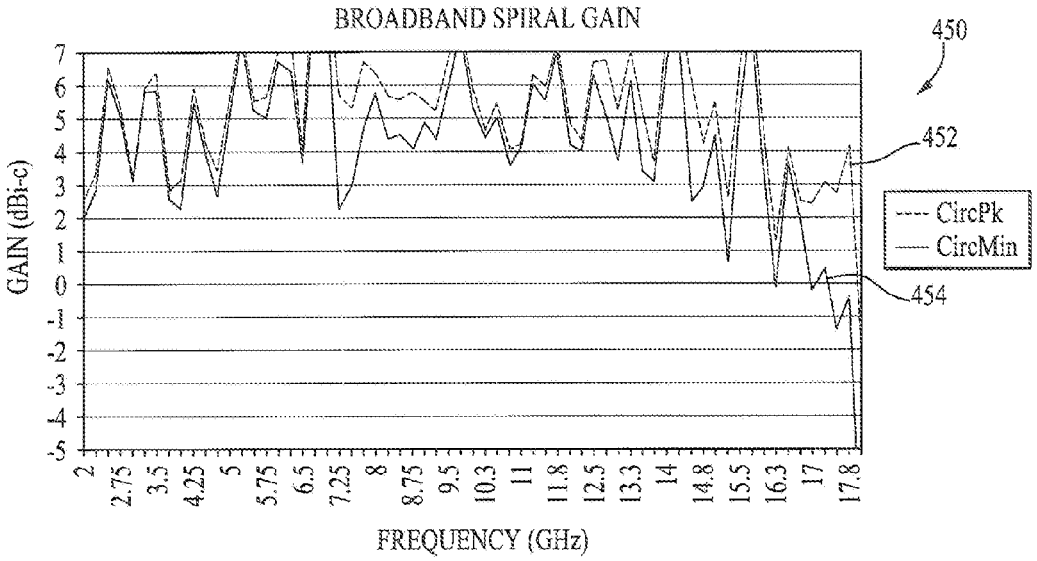
FIG. 4B illustrates the gain at boresight versus frequency (broadband spiral gain) for the range of approximately 2 GHz to approximately 18 GHz match, according to some embodiments of the invention.

FIG. 4A illustrates the gain at boresight versus frequency (broadband spiral gain) for the range of approximately 0.2 GHz (230 MHz) to approximately 2 GHz match, and is depicted as reference character 400. FIG. 4B illustrates the gain at boresight versus frequency (broadband spiral gain) for the range of approximately 2 GHz to approximately 18 GHz match, and is depicted as reference character 450. Thus, FIGS. 4A & 4B depict the circular polarity gain versus frequency, according to embodiments of the invention. FIGS. 4A and 4B show close correlation to the expected gain. The plots depicted show the calculated maximum and minimum peaks of the antenna's elliptical circularity. Curve 402 (FIG. 4A) shows the maximum peaks. Curve 404 (FIG. 4A) shows the minimum peaks. Curves 452 and 454 show the maximum and minimum peaks, respectively, on FIG. 4B. The differences between these values indicates axial ratio, which is shown on FIGS. 5A and 5B.

In FIGS. 4A & 4B, the gain has a sharp rise/dip around 0.35 GHZ. This is not, however, an accurate reflection of the true antenna gain, as the standard gain antenna has a sharp fall-off below 0.35 GHz, and small changes in frequency or other factors cause a sizeable difference between the standard gain antenna measurement and the antenna under test (AUT) measurement. The real gain would follow a straight line between the gain at about 0.43 GHz and 0.23 GHz. The same is true for the gain at 2 GHz, noting the fall-off above about 1.85 GHz. The second Gain plot (FIG. 4B) shows a gain of 2 dBi-c at 2 GHz, thus the gain would be expected to stay around this value in the lower band test.

Figure 5A:
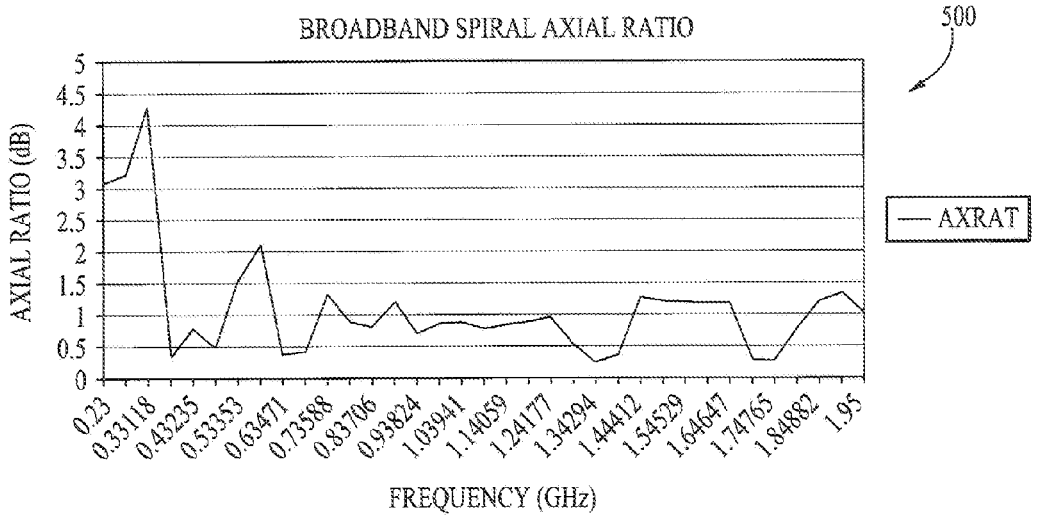
FIG. 5A illustrates axial ratio at boresight versus frequency (broadband spiral axial ratio) for the range of approximately 0.2 GHz (230 MHz) to approximately 2 GHz, according to some embodiments of the invention.
Figure 5B:
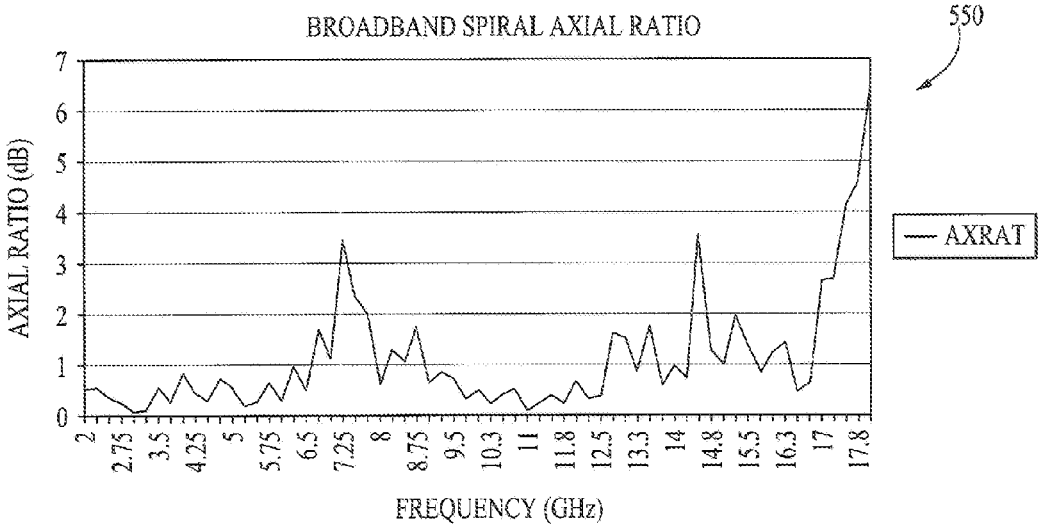
FIG. 5B illustrates axial ratio at boresight versus frequency (broadband spiral axial ratio) for the range of approximately 2 GHz to approximately 18 GHz, according to some embodiments of the invention.

FIG. 5A illustrates axial ratio at boresight versus frequency (broadband spiral axial ratio) for the range of approximately 0.2 GHz (230 MHz) to approximately 2 GHz, and is depicted as reference character 500. FIG. 5B illustrates axial ratio at boresight versus frequency (broadband spiral axial ratio) for the range of approximately 2 GHz to approximately 18 GHz, and is depicted as reference character 550.

The Axial ratio is very good, with the exception of the lowest frequencies and a few isolated frequencies (7.25 GHz and 14.8 GHz), with an increase from 17-18 GHz. The low frequency Axial Ratio increase is due to the antenna being slightly too small for 230 MHz operation. This could be mitigated with a larger antenna diameter using the same arm geometry. However, many fabricated board distributors limit printed circuit boards at 24 inch diameter.

Note that the Axial Ratio will have an uncertainty of approximately +/−0.4 dB and the gain an uncertainty of +/−0.5 dB, when the testing environment is outfitted with equipment and gain standard antennas for broadband measurements.

The antenna power pattern plots (FIGS. 6 through 12) have some variation in pattern shape. This is due to the nature of the antenna cavity cone causing some harmonic modes on the spiral. FIGS. 6 through 12 depict a few of the representative patterns.

Figure 6:
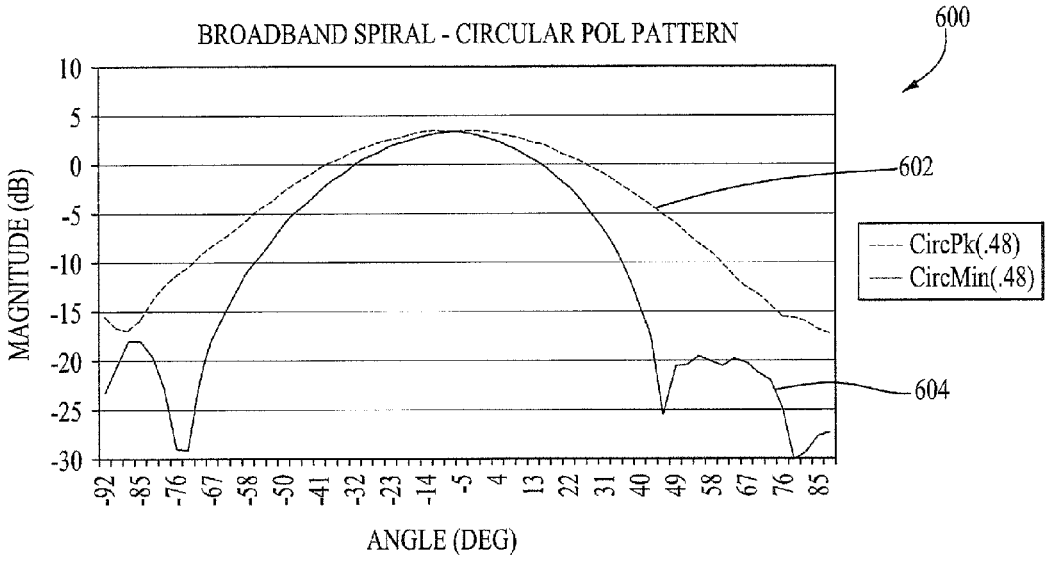
FIG. 6 illustrates the power pattern at 0.48 GHz, according to some embodiments of the invention.
Figure 7:
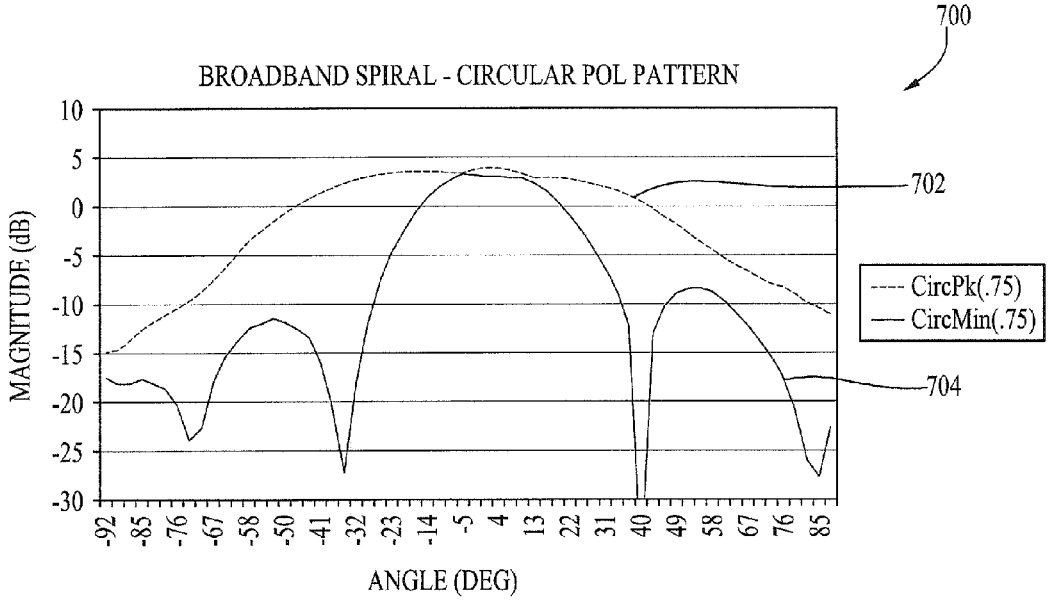
FIG. 7 illustrates the power pattern at 0.75 GHz, according to some embodiments of the invention.
Figure 8:
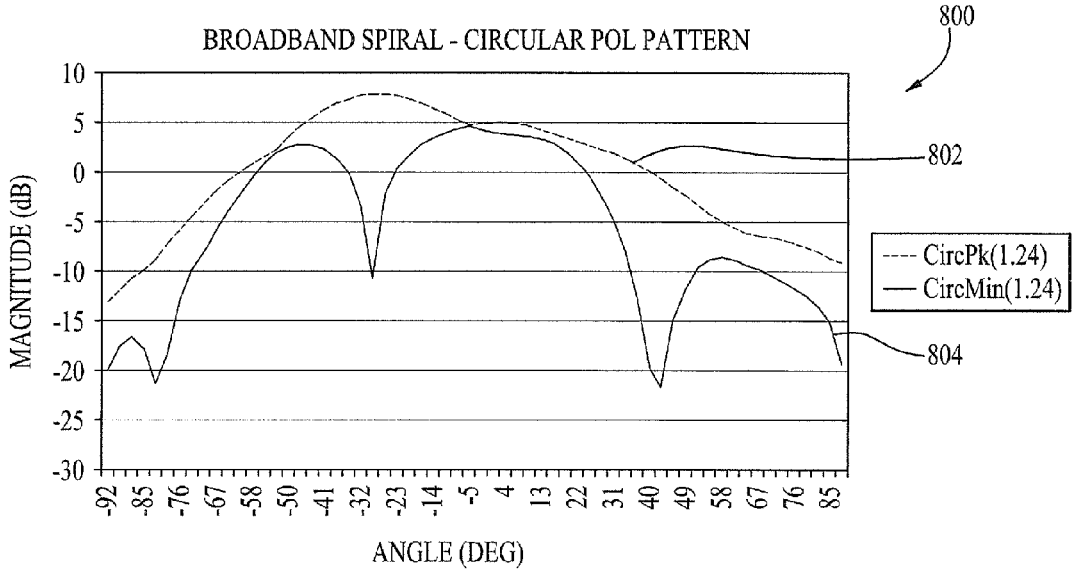
FIG. 8 illustrates the power pattern at 1.24 GHz, according to some embodiments of the invention.
Figure 9:
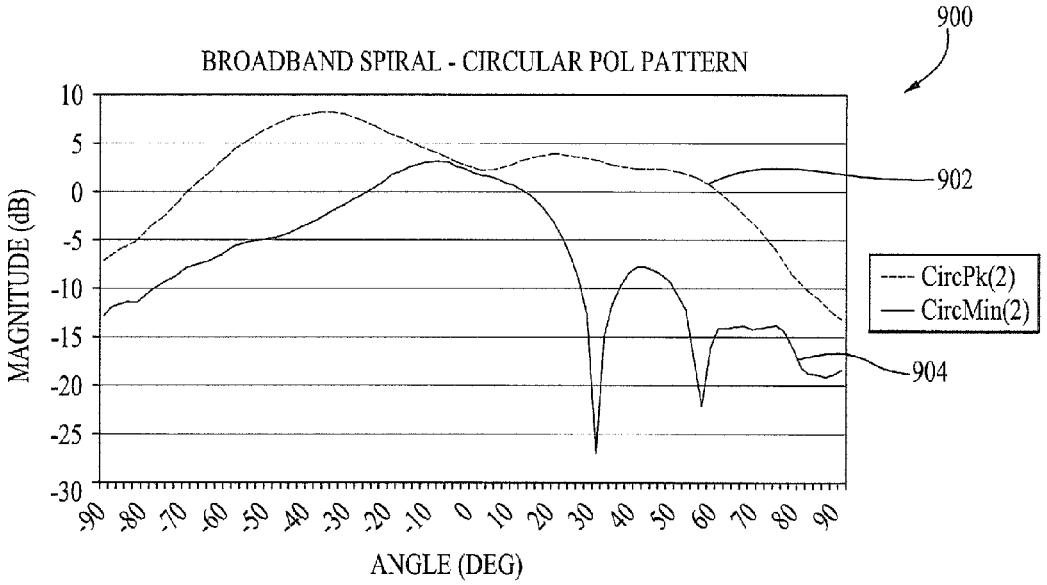
FIG. 9 illustrates the power pattern at 2 GHz, according to some embodiments of the invention.
Figure 10:
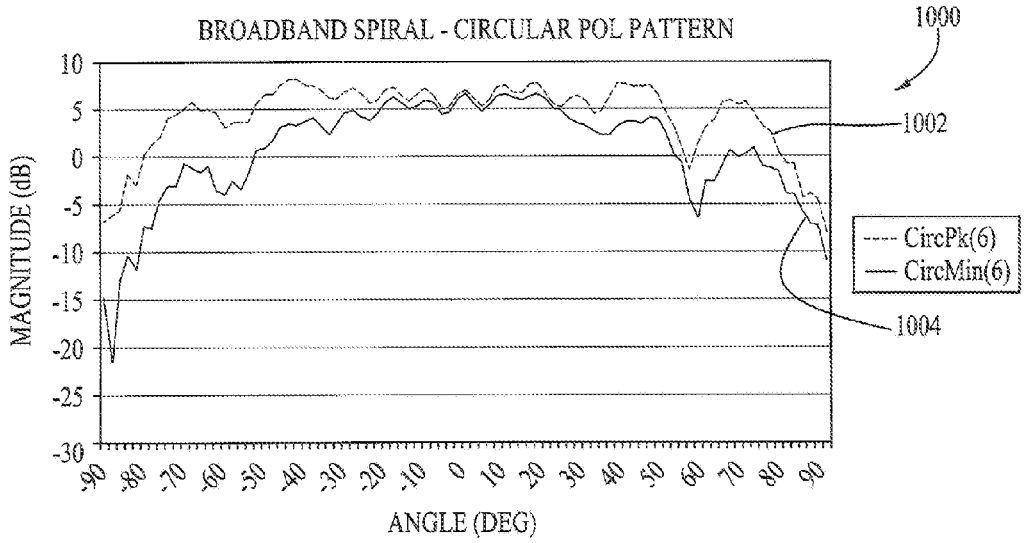
FIG. 10 illustrates the power pattern at 6 GHz, according to some embodiments of the invention.
Figure 11:
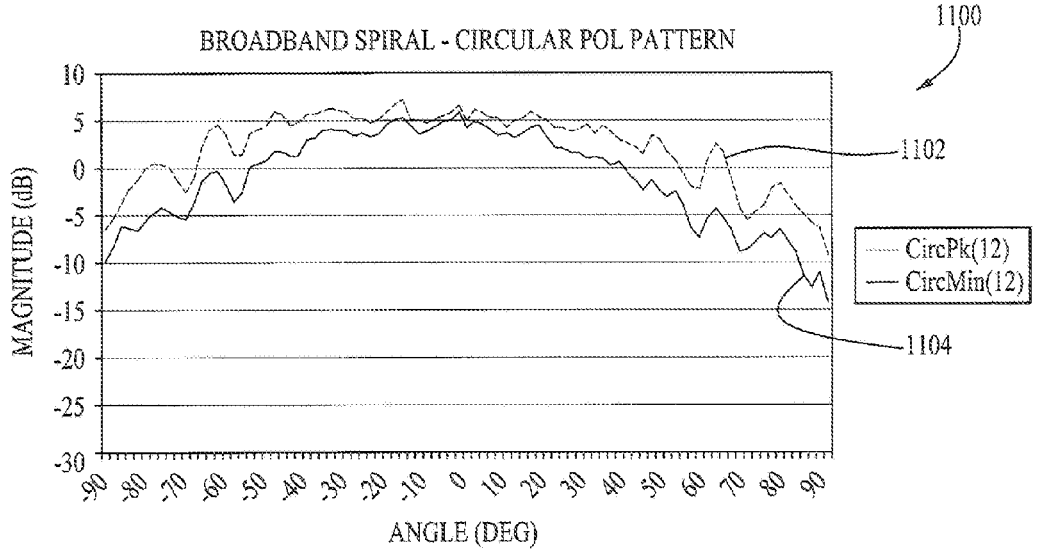
FIG. 11 illustrates the power pattern at 12 GHz, according to some embodiments of the invention.
Figure 12:
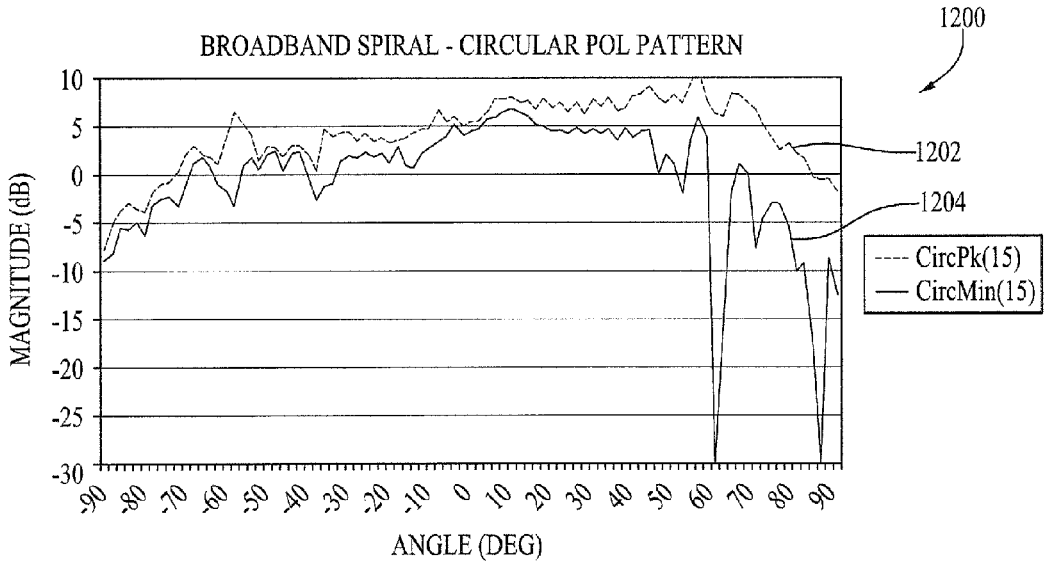
FIG. 12 illustrates the power pattern at 15 GHz, according to some embodiments of the invention.

FIG. 6 illustrates the power pattern at 0.48 GHz, and is depicted as reference character 600. Curves 602 and 604 show the maximum and minimum peaks, respectively, on FIG. 6. FIG. 7 illustrates the power pattern at 0.75 GHz, and is depicted as reference character 700. Curves 702 and 704 show the maximum and minimum peaks, respectively, on FIG. 7. FIG. 8 illustrates the power pattern at 1.24 GHz, and is depicted as reference character 800. Curves 802 and 804 show the maximum and minimum peaks, respectively, on FIG. 8. FIG. 9 illustrates the power pattern at 2 GHz, and is depicted as reference character 900. Curves 902 and 904 show the maximum and minimum peaks, respectively, on FIG. 9. FIG. 10 illustrates the power pattern at 6 GHz, and is depicted as reference character 1000. Curves 1002 and 1004 show the maximum and minimum peaks, respectively, on FIG. 10. FIG. 11 illustrates the power pattern at 12 GHz, and is depicted as reference character 1100. Curves 1102 and 1104 show the maximum and minimum peaks, respectively, on FIG. 11. FIG. 12 illustrates the power pattern at 15 GHz, and is depicted as reference character 1200. Curves 1202 and 1204 show the maximum and minimum peaks, respectively, on FIG. 12.

Figure 13A:
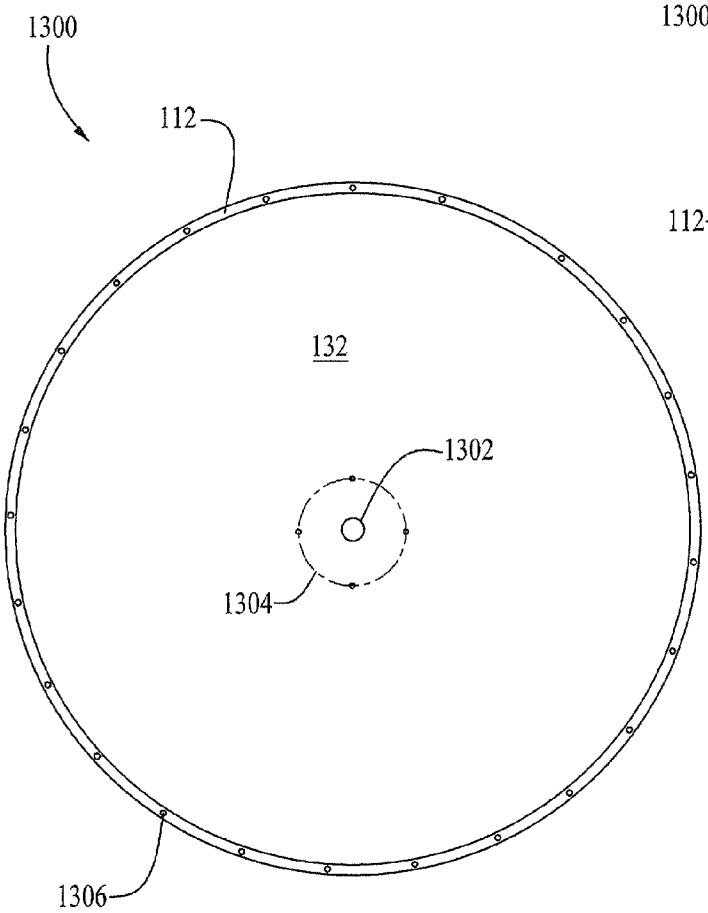
FIG. 13A is a plan view of a cavity assembly, according to some embodiments of the invention.
Figure 13B:
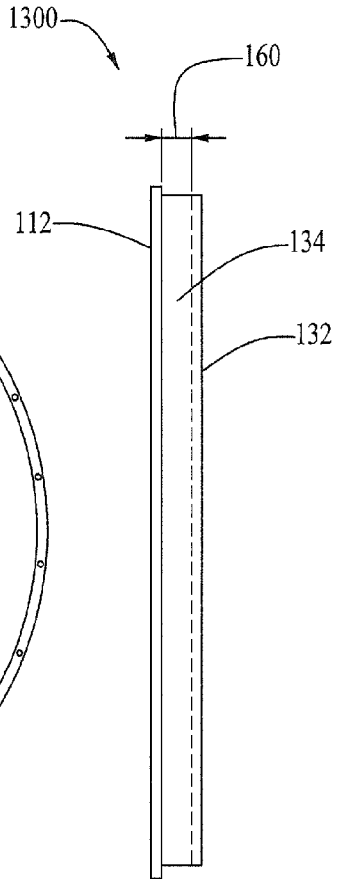
FIG. 13B is a profile view of the cavity assembly shown in FIG. 13A, according to some embodiments of the invention.

FIG. 13A is a plan view of a cavity assembly, according to some embodiments of the invention. FIG. 13B is a profile view of the cavity assembly shown in FIG. 13A, according to some embodiments of the invention. The cavity assembly in each is depicted as reference character 1300. In FIG. 13A, the base plate 132 is shown with an aperture 1302. Reference character 1304 depicts the approximate bolt circle pattern for the antenna cavity cone 116 (FIG. 1A) to connect to the base plate 132. Reference character 1306 depicts the approximate hole/screw locations for attaching the lip ring 112 to the dielectric substrate/printed circuit board 102.

As shown in FIG. 13B, the metallic ring 112 is mounted to the wall ring 134. The bottom (base) plate 132 is tack welded to the wall ring 134. FIG. 13A depicts 24 screw locations (holes) 1306 that are drilled after assembly of the base plate 132, wall ring 134, and metallic ring 112. The holes 1306 are approximately 15 degrees apart on a 25.40 inch diameter. Hole concentricity is approximately 0.005.

Figure 14A:
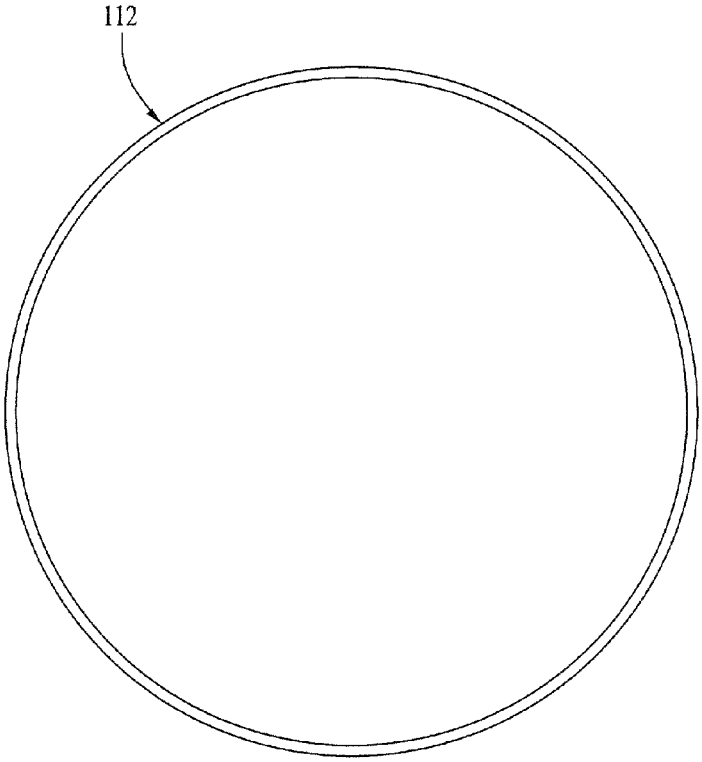
FIG. 14A is a plan view of a metallic ring, according to some embodiments of the invention.
Figure 14B:
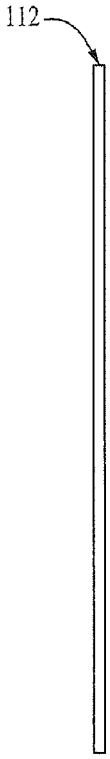
FIG. 14B is a profile view of the metallic ring in FIG. 14A, according to some embodiments of the invention.

FIG. 14A is a plan view of a metallic ("lip") ring, according to some embodiments of the invention. FIG. 14B is a profile view of the metallic ("lip") ring in FIG. 14A. Reference character 112 refers to the metallic ring in both FIGS. 14A & 14B. The metallic ring 112 is aluminum and is approximately 0.15 inches thick.

Figure 15A:
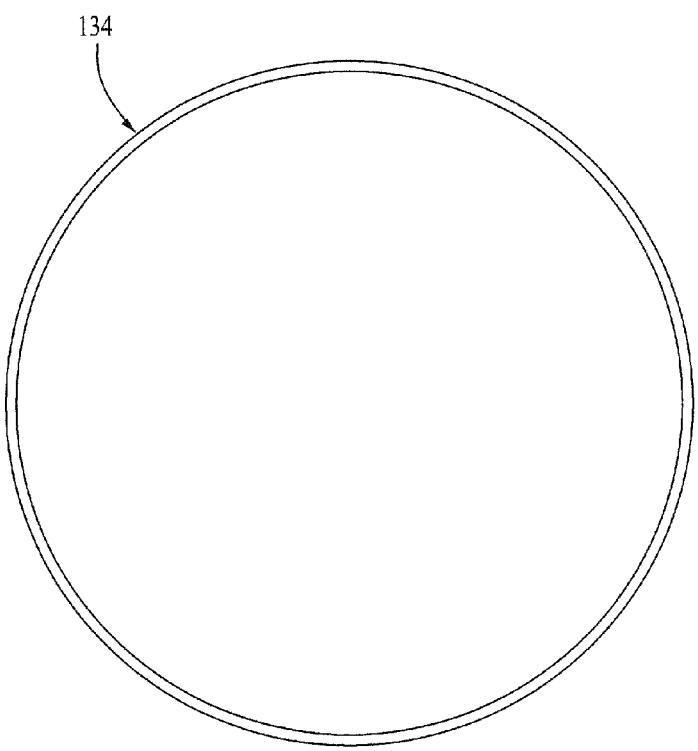
FIG. 15A is a plan view of a wall ring, according to some embodiments of the invention.
Figure 15B:
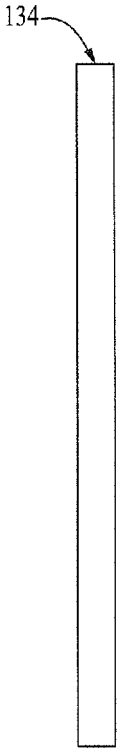
FIG. 15B is a profile view of the wall ring in FIG. 15A, according to some embodiments of the invention.

FIG. 15A is a plan view of a wall ring, according to some embodiments of the invention. FIG. 15B is a profile view of the wall ring in FIG. 15A. Reference character 134 refers to the wall ring. The wall ring 134 is approximately 1.5 inches in height, which matches the antenna cavity depth.

Figure 16A:
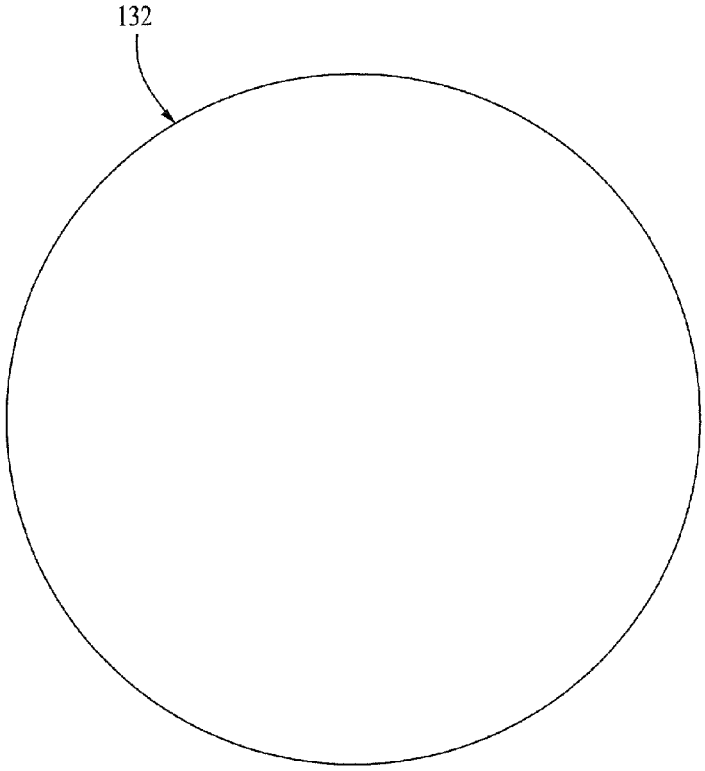
FIG. 16A is a plan view of a base plate, according to some embodiments of the invention.
Figure 16B:
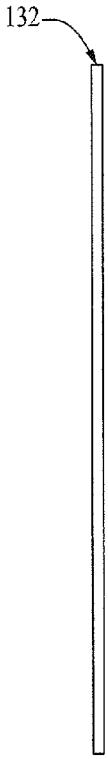
FIG. 16B is a profile view of the base plate in FIG. 16A, according to some embodiments of the invention.

FIG. 16A is a plan view of a base plate, according to some embodiments of the invention. FIG. 16B is a profile view of the base plate in FIG. 16A. Reference character 132 refers to the base plate. The base plate 132 is aluminum, has a diameter of approximately 25.0 inches, and is approximately 0.10 inches thick.

Figure 17:
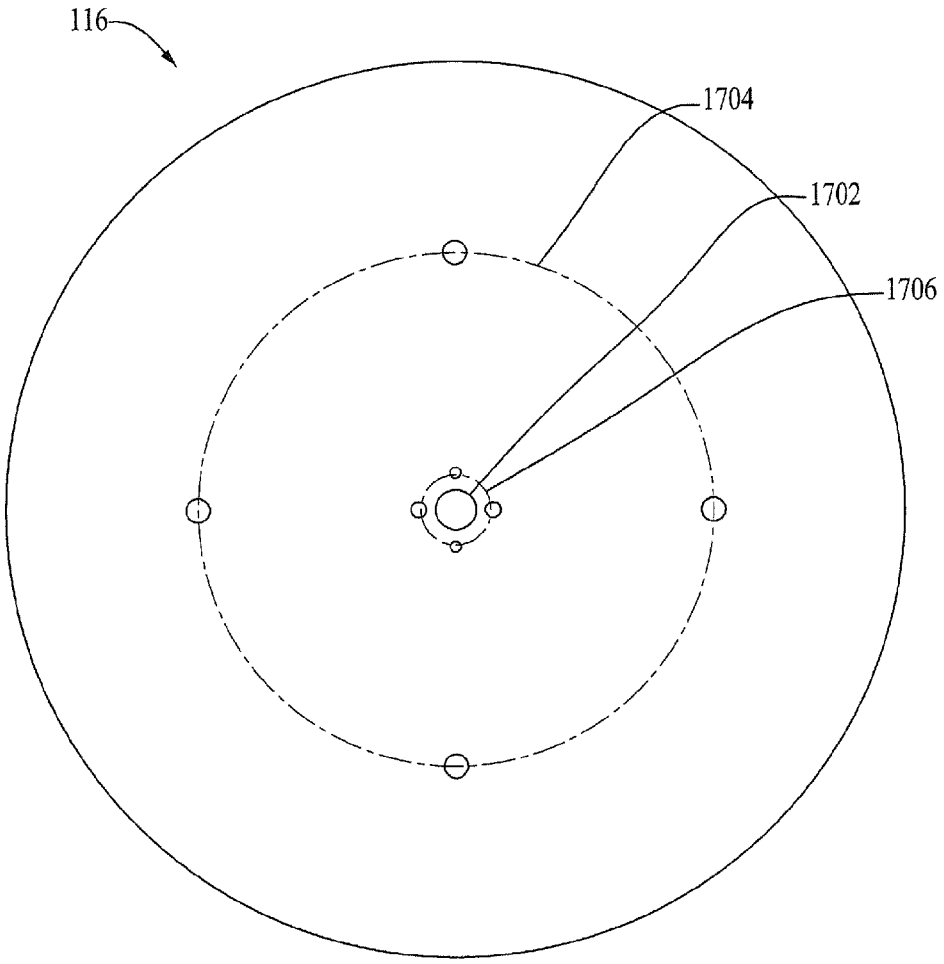
FIG. 17 is a bottom view of an antenna cavity cone, according to some embodiments of the invention.

FIG. 17 is a bottom view of an antenna cavity cone and is depicted as reference character 116. Reference character 1702 is an aperture through the antenna cavity cone 116 allowing the balun 126 (FIG. 1A) to connect with the connector cap 136 (FIG. 1A). Reference character 1704 depicts the approximate bolt circle pattern for the antenna cavity cone 116 to connect with the base plate 132 (FIG. 1A).

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A minimum cavity depth antenna, comprising:

a dielectric substrate having an upper side, a lower side, and an outward edge;

a spiral antenna having first and second antenna arms mounted on said dielectric substrate;

a metallic ring formed around said first and second antenna arms, wherein said metallic ring is mounted on said outward edge of said dielectric substrate and extends around said outward edge and adjacent to said lower side of said dielectric substrate;

wherein each of said first and second antenna arms have logarithmic spiral antenna arm geometry from the center of said dielectric substrate out to about 2.6 inch radius, and wherein from about 2.6 inch radius, said first and second antenna arms transition to Archimedean spiral arms having arms about 0.2 inch arm width and 0.2 inch arm spacing;

wherein said first antenna arm is resistively-terminated at a first resistor, wherein said second antenna arm is resistively-terminated at a second resistor, wherein said first and second resistors are connected to said metallic ring;

an antenna cavity cone having an outer surface, an inner surface, and a bottom lip, wherein an antenna cavity cone cap is adjacent to said outer surface of said antenna cavity cone, wherein said antenna cavity cone cap is attached to said lower side of said dielectric substrate;

a tapered microstrip balun circuit having a proximal end and a distal end, wherein said tapered microstrip balun circuit is electrically-connected to said first and second antenna arms at said proximal end;

a bottom plate attached to said bottom lip of said antenna cavity cone;

a wall ring connecting said bottom plate to said metallic ring; and a connector cap mounted on the lower side of said bottom plate, wherein said connector cap is electrically-connected to said distal end of said tapered microstrip balun circuit.

2. The antenna according to claim 1, wherein each of said dielectric substrate, said antenna cavity cone cap, said antenna cavity cone, and said bottom plate has at least one aperture extending through said dielectric substrate, said antenna cavity cone cap, said antenna cavity cone, and said bottom plate.

3. The antenna according to claim 1, further comprising a cone insert inside said antenna cavity cone, wherein said cone insert is an aluminum cylinder having a proximal end and a distal end, said proximal end attached to said inner surface of said antenna cavity cone, said distal end attached to said bottom plate.

4. The antenna according to claim 1, wherein said antenna cavity cone cap has a diameter of about 2.0 inches and is adjacent to and centered on said lower side of said dielectric substrate.

5. The antenna according to claim 1, wherein said antenna cavity cone is aluminum, wherein said outer surface of said antenna cavity cone is a polished aluminum surface.

6. The antenna according to claim 1, wherein said tapered microstrip balun circuit has an impedance taper of about 50 to 100 ohms.

7. The antenna according to claim 1, wherein said spiral antenna has a diameter of about 28 inches and said wall ring has a wall height of about 1.5 inches.

8. An antenna, comprising:

a fiberglass circuit board having an upper side, a lower side, and an outward edge;

two spiraling conductive radiator arms defined by a first antenna arm and a second antenna arm, said two spiraling conductive radiator arms etched on said fiberglass circuit board;

wherein each of said two spiraling conductive radiator arms have logarithmic spiral antenna arm geometry from the center of said fiberglass circuit board out to about 2.6 inch radius, and wherein from about 2.6 inch radius, said first and second antenna arms transition to Archimedean spiral arms having arms about 0.2 inch arm width and 0.2 inch arm spacing;

a metallic ring formed around said two spiraling conductive radiator arms, wherein said metallic ring is mounted on said outward edge of said fiberglass circuit board and extends around said outward edge and adjacent to said lower side of said fiberglass circuit board;

an antenna cavity cone having an outer surface, an inner surface, and a bottom lip, wherein an antenna cavity cone cap is adjacent to said outer surface of said antenna cavity cone, wherein said antenna cavity cone cap is attached to said lower side of said fiberglass circuit board;

a tapered microstrip balun circuit having a proximal end and a distal end, said tapered microstrip balun circuit is electrically-connected, at said proximal end, to said two spiraling conductive radiator arms;

a bottom plate attached to said bottom lip of said antenna cavity cone;

a wall ring connecting said bottom plate to said metallic ring; and a connector cap mounted on the lower side of said bottom plate, wherein said connector cap is electrically-connected to said distal end of said tapered microstrip balun circuit.

9. The antenna according to claim 8, wherein each of said fiberglass circuit board, said antenna cavity cone cap, said antenna cavity cone, and said bottom plate has at least one aperture extending through said fiberglass circuit board, said antenna cavity cone cap, said antenna cavity cone, and said bottom plate.

10. The antenna according to claim 8, wherein said tapered microstrip balun circuit has an impedance of about 100 ohms.

11. The antenna according to claim 8, further comprising a cone insert inside said antenna cavity cone, wherein said cone insert is an aluminum cylinder having a proximal end and a distal end, said proximal end attached to said inner surface of said antenna cavity cone, said distal end attached to said bottom plate.

12. The antenna according to claim 8, wherein said first antenna arm is resistively-terminated at a first resistor, wherein said second antenna arm is resistively-terminated at a second resistor, wherein said first and second resistors are connected to said metallic ring.

13. The antenna according to claim 8, wherein said antenna cavity cone cap has a diameter of about 2.0 inches and is adjacent to and centered on said lower side of said fiberglass circuit board.

14. The antenna according to claim 8, wherein said antenna cavity cone is aluminum, wherein said outer surface of said antenna cavity cone is a polished aluminum surface.

15. The antenna according to claim 8, wherein said two spiraling conductive radiator arms have a diameter of about 28 inches and said wall ring has a wall height of about 1.5 inches.

* * * * *